United States Patent [19]

Bayer et al.

[11] 4,037,852

[45] July 26, 1977

[54] SKATEBOARD BRAKING METHOD AND APPARATUS

[76] Inventors: Arthur J. Bayer, 412 N. Curry; Henry Schwarzer, 2815 Baker Drive, both of Carson City, Nev. 89701

[21] Appl. No.: 667,558

[22] Filed: Mar. 17, 1976

[51] Int. Cl.[2] ..... A63C 17/14

[52] U.S. Cl. ..... 280/87.04 A; 188/29; 280/11.2

[58] Field of Search ..... 188/29, 71.3, 74; 280/11.2, 87.04 A, 87.04 R

[56] References Cited

U.S. PATENT DOCUMENTS

| | | | |
|---|---|---|---|
| 1,933,421 | 10/1933 | Elliotte | 280/87.04 R |
| 2,051,762 | 8/1936 | Vincent | 280/87.04 R |
| 3,288,251 | 11/1966 | Sakwa | 188/29 |
| 3,385,608 | 5/1968 | Waddell | 188/29 X |
| 3,945,655 | 3/1976 | Banks | 280/11.2 |

FOREIGN PATENT DOCUMENTS

| | | | |
|---|---|---|---|
| 100,282 | 1/1898 | Germany | 280/11.2 |

*Primary Examiner*—George E. A. Halvosa
*Attorney, Agent, or Firm*—Herbert C. Schulze

[57] ABSTRACT

This invention is a method, and apparatus for performing the method, for safety braking of skateboards wherein the method is practiced by the activation of a friction device to one pair of wheels of a skateboard in such manner that one using such a skateboard may bring the board to a controlled stop.

1 Claim, 4 Drawing Figures

SKATEBOARD BRAKING METHOD AND APPARATUS

CROSS REFERENCE TO RELATED PATENT APPLICATIONS

There are no patent applications related to this application filed by us.

BACKGROUND OF THE INVENTION

1. Field of the Invention

This invention is in the general field of braking methods and devices for wheeled vehicles, and is more particularly directed to a method and device for safety braking of skateboards.

2. Description of the Prior Art

There are many, and varied, braking devices for wheeled vehicles, which are much too numerous to mention. The devices commonly utilized comprise friction pads or the like which may be forced against a drum, disc, or other suitable engaging mechanism connected to the wheel. Likewise, there have been devices connected to the vehicle which press directly against the running surface, such as the braking arrangements frequently used with cable cars and the like, which are known to those skilled in the art. Further there have been some braking devices designed to contact directly with a wheel, or even the running surface. Such devices have been recognized, such as certain brake arrangements heretofore used on wagons, and the like, wherein a driver could press upon a pedal and cause a wooden member or the like to come in contact with the running surface of the wheel. All such devices have been specially constructed wherein leverage and the like may be accomplished through extensive mechanism from an operator at a remote distance from the running surface.

Skateboards are a particular form of vechicle, particularly designed for entertainment, and in which no adequate braking system has been heretofore devised due to the problems of creating appropriate and controllable leverage. While the prior art in braking devices is extensive, there is no prior art in braking devices and methods for skateboards.

SUMMARY OF THE INVENTION

Skateboards, normally a small elongated platform with two pairs of wheels, one near each end, are in wide use. These boards are used for entertainment and transport under certain conditions.

The boards and their wheels are relatively unsophisticated in construction and are not so designed that braking is readily possible.

There are numerous injuries attributed to the use of skateboards, and particularly the inability to properly stop in a controlled manner, especially on slopes.

We have made a study of the situation and devised a method, and apparatus for performing the method, wherein controlled braking and thus stopping of a skateboard may readily be accomplished, without defeating the entertainment aspects and thrills of the normally uncontrolled skateboard action.

In accomplishing the desired braking and controlled stopping, we affix a pedal arrangement, preferrably to the rear of the skateboard and above the rear set of wheels. This pedal arrangement is further connected to a friction device which comes in contact with the wheels when the pedal is activated and comes in contact in a controlled manner depending upon the pedal pressure.

In one form of an apparatus for performing this method, a pair of friction devices press directly upon the running surface of the wheels; in another form of an apparatus; a pair of friction devices are spread apart from one another and press inwardly against the interior verticle surface of the wheels; in still another form a pair of friction devices press upon the interior of hollow cylindrical wheels.

Other forms of apparatus to practice a method of this invention could be devised by those skilled in the art.

It is an object of this invention to provide a method and apparatus for controllably stopping the movement of a skateboard during use;

Another object of this invention is to provide such a method and apparatus wherein the activation is by use of a pedal operated by a skateboard user's foot;

Another object of this invention is to provide such a method and apparatus wherein the normal uncontrolled function of a skateboard is not affected during times where stopping is not desired.

The foregoing and other object and advantages of this invention will become clear to those skilled in the art upon reading the following description of a preferred embodiment in conjunction with a review of the appended drawings.

DESCRIPTION OF A PREFERRED EMBODIMENT

Figures 1, 2:
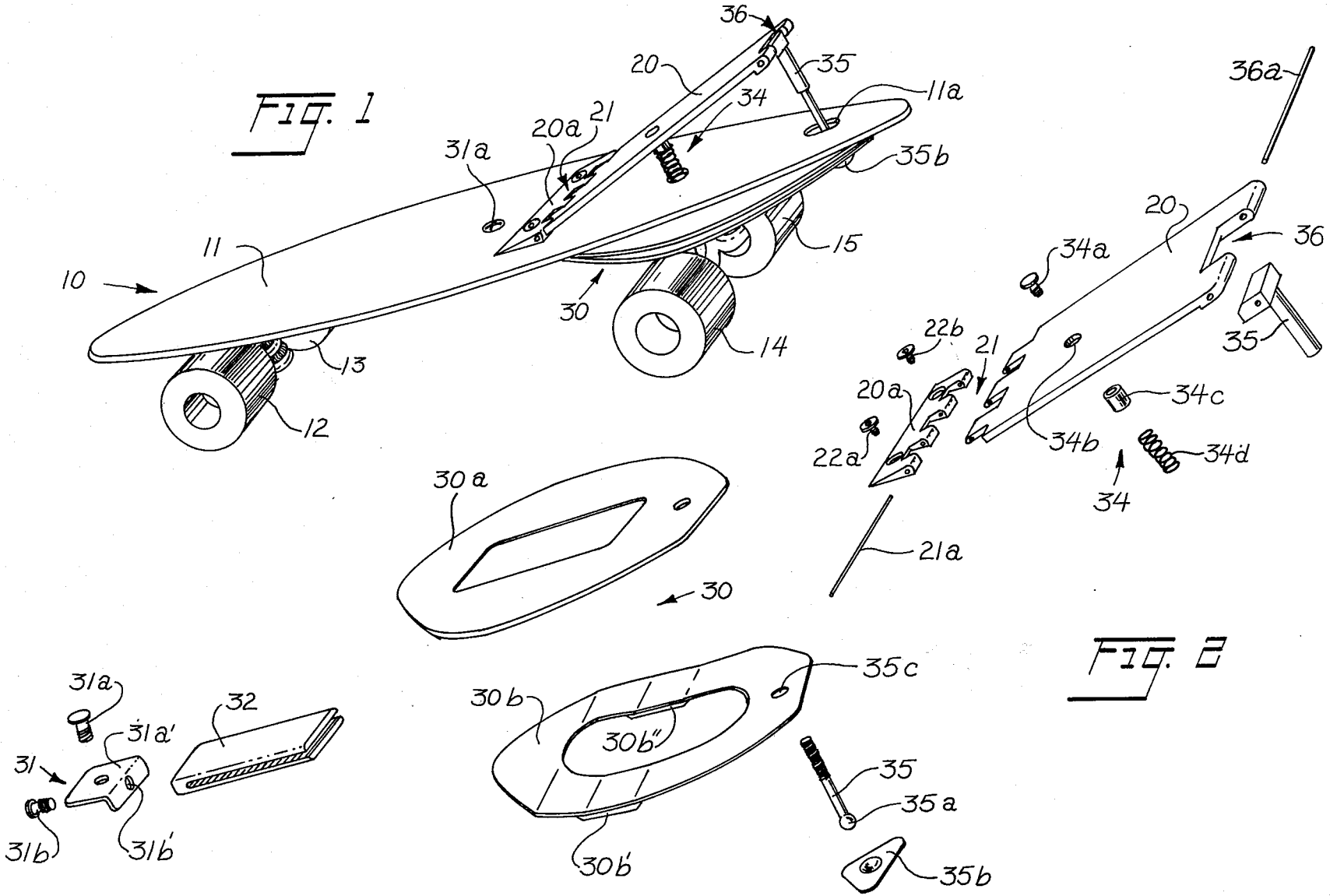
FIG. 1 is a prospective of a skateboard equipped with a preferred embodiment of an apparatus to practice the method of this invention.
FIG. 2 is an exploded view of the apparatus of FIG. 1.

FIG. 1 illustrates an assembled skateboard having connected in cooperative relationship, thereto, an apparatus suitable to practice the method of this invention. Examination of FIGS. 1 and 2 show the skateboard assembly generally 10 composed of an elongated platform 11 normally formed of rigid material, and pair of front wheels 12 and 13, and a pair of rear wheels 14 and 15. Additionally, this particular embodiment of a skateboard is shown to include a pedal 20 hinged to member **20*a* by hinge 21. Also, a braking element 30 is connected beneath the skateboard platform 11 by bolts or the like as will be explained, and is activated by rod 35 connected between the pedal and the braking element. In use, the braking element 30 will contact wheels 14 and 15 at points 30*b*' and 30*b*'' respectively. The spring 34 acts in such a manner as to return the pedal and lift the braking element, due to rod 35**, so that there is no contact between the braking element and the wheels when braking is not desired.

In reference to FIG. 2, the pedal element 20 can be fastened to the upper surface of platform 11 by the following method. Screws, rivets, or the like, **22*a*, 22*b*, secure unit 20*a* in place while hinge unit 21, in cooperation with pin 21*a*, secures unit 20*a* with the pedal element 20 and the pedal element can freely pivot at the joint 21**.

The braking element can be fastened to the lower surface of platform 11 by the following method. Bracket 31 is fastened to the bottom surface of the platform by use of a screw, a rivet, or the like, 31*a;* face 31*a* will butt against the bottom surface of the platform. Braking elements, top, 30*a* and, bottom, 30*b* will be inserted within and fastened to clip element 32 and the clip element will be fastened to bracket 31 by a rivet, screw, or the like, 31*b,* through hole 31*b'*.

Rod 35 will be attached to pedal element 20 by a hinge-pin arrangement 36 as shown. This is necessary to accomodate for differences in angular relationship between the rod and the pedal element when the pedal is moved. The rod 35 will pass through hole 11*a* in platform 11 and the rounded end of the rod 35*a* will terminate in a socket element 35*b,* the socket element being fastened to the underside of braking element 30*b.* Hole 35*c* is smaller than the diameter of ball 35*a,* therefore, when rod 35 moves downward, pressure against 35*b* will move the braking element downward and when rod 35 moves upward, pressure of the ball 35*a* against the underside of 30*b,* at 35*c,* will cause braking element 30*b* to move upward. Further, the ball-socket joint at 35*a,* 35*b* is necessary so as to accomodate for differences in angular relationship between the rod and the braking element when the pedal element is moved.

In spring assembly 34 a small pin 34*c* is fastened to the bottom of pedal 20 by use of a screw, rivet, or the like, 34*a.* One end of spring 34*d* will fit over pin 34*c* and the other end of the spring will terminate in a hole which is drilled in the platform 11.

Figure 3:
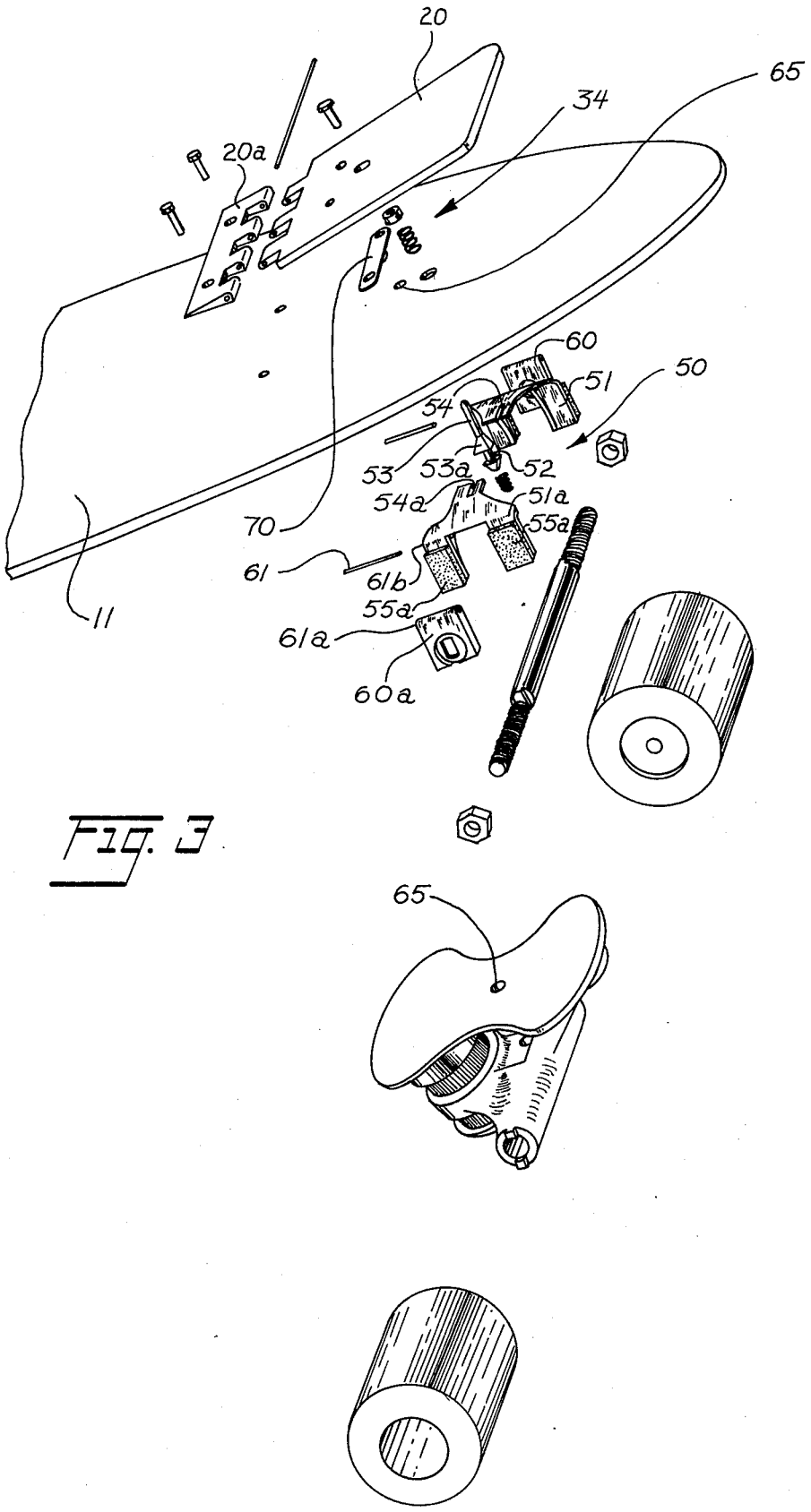
FIG. 3 is an exploded view of an alternate embodiment of a braking apparatus.

FIG. 3 illustrates an alternative embodiment of an apparatus suitable to practice the method of this invention. Pedal 20 and spring assembly 34 have been previously discussed. Braking assembly 50 consists of brake elements 51, 51*a,* which are fastened together and pin 52 of actuator element 53 is inserted between slots 54, 54*a* with the wide surface area 53*a* resting on top of brake elements 51, 51*a.*

Plates 60, 60*a,* are affixed to the rear axle and flush against the inside surface of each rear wheel, leaving barely enough space so that the wheels and the plates do not rub. The brake elements are then hinged to the plates with use of pin 61 inserted in slots 61*a,* 61*b.* Only one element is being referred to but both elements are assembled alike. The top of actuator element 53 can project up through hole 65 to above the upper surface of the platform or the top of the actuator element can actually be below the upper surface. Plate 70 is fastened to the lower surface of pedal 20 and the plate can be flat on the underside or have a nipple, which ever is necessary, to contact the top of actuator element 53.

Braking is effected in this manner. When pedal 20 is depressed downward, plate 70 contacts actuator element 53 and forces the element downward. This in turn causes pressure against the upper surface of brake elements 51, 51*a,* and due to the hinged connections at 61*a* and 61*b,* the surfaces 55*a* are moved outward and contact the inside of the rear wheels. Spring assembly 34 will return the pedal to the upper position.

Figure 4:
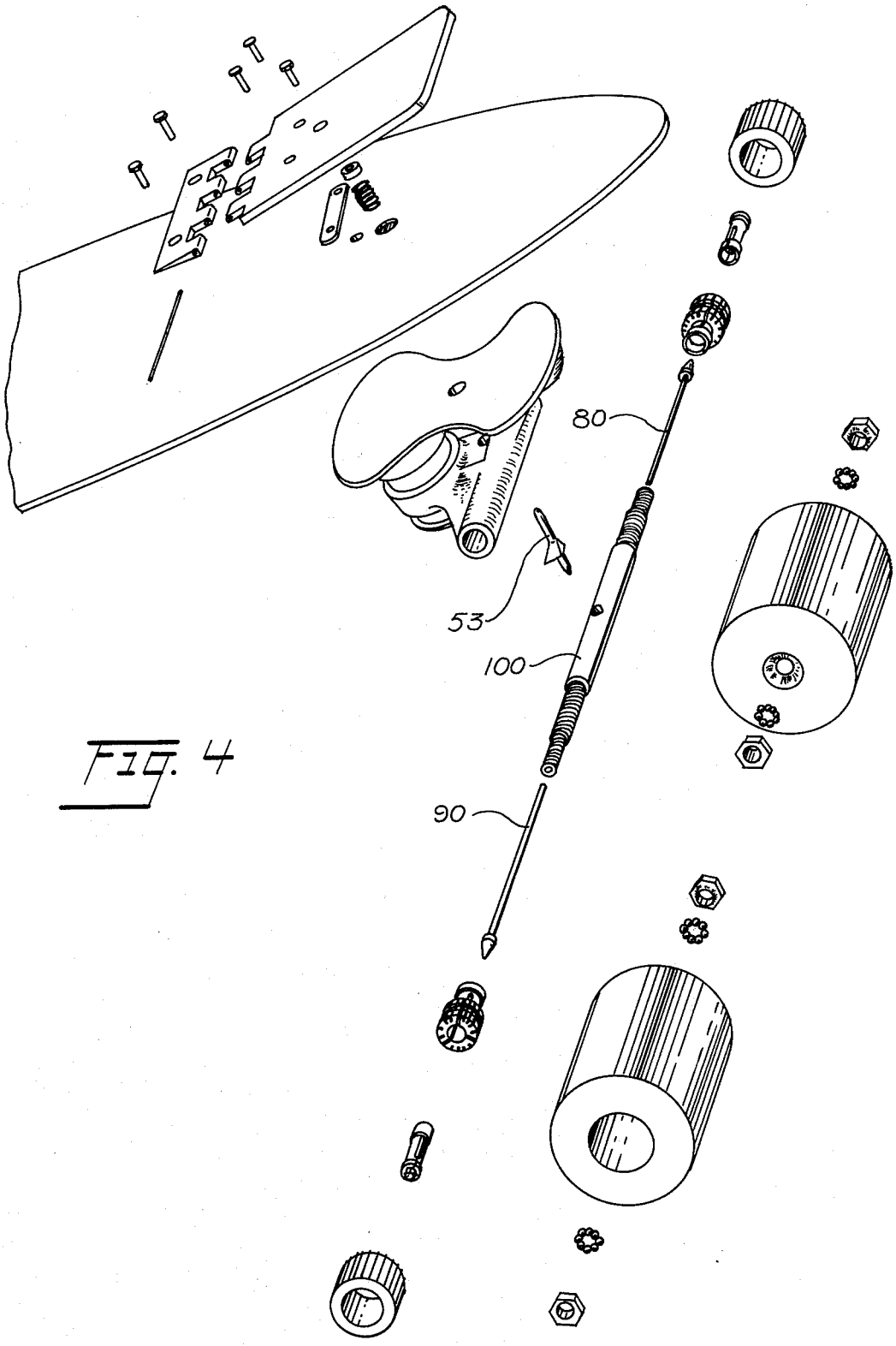
FIG. 4 is an exploded view of another alternate embodiment of a braking mechanism suitable to practice the method of this invention.

FIG. 4 illustrates another embodiment of a braking mechanism. This embodiment is similar to the abovementioned with the following exceptions. Actuator element 53, when depressed downward, will cause pins 80, 90, to come into friction contact with the interior assembly of the rear wheels, thereby causing a braking force. The assembly 100 can be designed so that the movement of pins 80, 90 are caused by a ball effect, a pivotal effect, a leverage effect, or the like as is known to those skilled in the art.

During the use and practice of these methods, the skateboard is used in substantially the same manner as is customary without a braking arrangement. Normally, the rear foot on the board will be resting essentially upon the ball of the foot upon the platform, and if it is desired to stop, the user pivots on the ball of his foot until his heel or some other porion of his foot is appropriately positioned over the pedal at which time the pedal is appropriately contacted and depressed with the desired force to accomplish stopping within the distance required.

While the embodiments of this invention shown and described are fully capable of achieving the objects and advantages desired, it is to be understood that such embodiments are for purposes of illustration only, and not for purposes of limitation.

We claim:

1. The combination, with a skateboard comprising a platform with at least two pairs of wheels connected thereto on one side thereof, of:

1. Friction means pivotally supported by resilient members on the underside of said platform above one pair of wheels;
2. An activation lever attached to said friction means in such manner that said friction means is caused to come in contact with said wheels upon depression of said lever, and to be removed from contact upon elevation of said lever;
3. Hinge means pivotally attaching an end of said lever to said platform of said skateboard;
4. Spring means holding said lever normally at an angular relation to said platform, with the end of said lever not attached to the platform at a distance from the platform; and
5. Elongated rod means causing attachment of the lever means to the friction means.

* * * * *